US005757125A

United States Patent [19]

Furlong et al.

[11] Patent Number: 5,757,125

[45] Date of Patent: May 26, 1998

[54] ELECTROLUMINESCENT LAMP WITH LEAD ATTACHMENT ISOLATION STRUCTURE, AND ROTARY ABRASION METHOD OF MANUFACTURE THEREOF

[75] Inventors: Kim Marlene Furlong, Enfield; Brian William McInerney, Lebanon; Robert Lee Bomhower, Plainfield, all of N.H.

[73] Assignee: Astronics Corporation, Inc., East Aurora, N.Y.

[21] Appl. No.: 555,595

[22] Filed: Nov. 9, 1995

[51] Int. Cl.[6] ..... H05B 33/06; H05B 33/10

[52] U.S. Cl. ..... 313/503; 313/511; 313/506; 445/24

[58] Field of Search ..... 427/66, 277; 445/24; 313/511, 503, 506

[56] References Cited

U.S. PATENT DOCUMENTS

| | | | |
|---|---|---|---|
| 3,464,534 | 9/1969 | Muncheryan | 219/121.63 |
| 3,895,208 | 7/1975 | Krause . | |
| 4,209,215 | 6/1980 | Verma | 439/497 |
| 4,425,496 | 1/1984 | le Fur et al. . | |
| 4,534,743 | 8/1985 | D'Onofrio et al. . | |
| 4,745,334 | 5/1988 | Kawachi . | |
| 5,223,687 | 6/1993 | Yuasa et al. . | |
| 5,276,382 | 1/1994 | Stocker et al. . | |
| 5,332,946 | 7/1994 | Eckersley et al. . | |

*Primary Examiner*—Kenneth J. Ramsey
*Attorney, Agent, or Firm*—Steven J. Hultquist

[57] ABSTRACT

An electroluminescent lamp comprising an electrode layer including a substrate with a main surface which has been coated with a film of a conductive material, the substrate comprising a region where the conductive material film has been removed from the substrate surface by rotary abrasion. The lamp of the invention may be fabricated using an electrode layer including a conductive material coated on a substrate, with rotary abrasion removal of a region of the conductive material, to form a lead attachment and/or edge isolation area on the electrode layer.

36 Claims, 16 Drawing Sheets

ELECTROLUMINESCENT LAMP WITH LEAD ATTACHMENT ISOLATION STRUCTURE, AND ROTARY ABRASION METHOD OF MANUFACTURE THEREOF

BACKGROUND OF THE INVENTION

1. Field of the Invention

The present invention relates to improved electroluminescent lamps having a lead attachment isolation structure, and methods of making such electroluminescent lamps.

2. Description of the Related Art

Electroluminescent lamps commonly comprise a laminated assembly including phosphor material, a dielectric layer, and front and rear electrodes, with leads for applying an alternating electric field across the electrodes, to cause the phosphor to emit radiant (luminescent) energy, e.g., in the visible light spectrum, infrared, or ultraviolet spectrum.

In such electroluminescent lamps, the phosphor material and dielectric layer between the electrodes, generally maintain the two electrodes in separated relationship to one another, thereby preventing them from short circuiting. However, the use of a lead terminal structure that deforms the layers of the lamp can cause contact between the two electrodes, particularly in a thin lamp. Such deformation of the lamp structure may for example occur when attaching leads to the lamp with a fully invasive lead terminal connector, such as one that pierces or crimps the electrodes, or with a semi-invasive connector, such as one that applies pressure to the electrode surfaces with a mechanical device. In such electroluminescent lamp articles, a relatively small amount of pressure, e.g., on the order of 5 pounds per square inch, can cause deformation resulting in contact between the two electrodes.

Examples of connectors which apply pressure to the electrode surfaces include alligator clip terminal connectors, spring-loaded connectors, and conductive elastomer strips compressed against the lamp. Thermal expansion of these types of connector can also cause deformation, e.g., in a pressure pad connection that is warmed and expands over time.

Deformation in extreme instances can cause the front and rear electrodes to contact one another, resulting in short circuiting when power is applied to the lamp. Such short circuiting degrades the performance of the lamp, and can result in diminution or loss of illumination capability of the electroluminescent lamp. Short circuiting in extreme circumstances may create a risk of fire, the risk of electric shock to the user of a lamp, or short circuit to other adjacent electrical devices.

To prevent the occurrence of these deleterious circumstances resulting from deformation of one of the front and rear electrode lamp layers relative to the other during lead attachment to the main lamp body, the attachment area of such electrode is desirably electrically isolated from the other electrode of the lamp assembly.

U.S. Pat. No. 5,276,382 teaches the use of a thin "line of interruption" in which a portion of the conductive material of the front electrode, in the form of a line between 0.005 and 0.010 inches wide, is removed by laser ablation. The line of interruption creates an isolated island that is electrically discontinuous from the remainder of the electrode, and provides the electrically isolated lead attachment area.

By this arrangement, a lead can be attached to the electrically isolated lead attachment area of the main body electrode to an outer electrode of the lamp. Short circuiting will not occur even if the electrically isolated lead attachment area of one of the electrodes contacts the other electrode, e.g., as a result of a crimping-type lead connector being applied to the laminated structure.

The method disclosed in U.S. Pat. No. 5,276,382, however, is time-consuming, involving the travel of the laser beam-generating apparatus over the periphery of the intended lead isolation area, at sufficient intensity of lasing energy and with sufficient accuracy to ablate the electrode metal film and form a continuous isolation line, without damaging the underlying substrate on which the electrode metal film has been deposited.

The foregoing difficulties of the process disclosed in U.S. Pat. No. 5,276,382 are magnified if a pulsed laser is used to scribe the metal electrode film to form the isolation line. To create a continuous line of constant width, every lasing pulse must be accurately indexed to and overlapped with the previous pulse. The narrow line of interruption may be discontinuous if the successively pulsed lasing areas are not completely overlapping, and thereby fail to provide electrical isolation.

Alternatively, the line may be continuous but may be narrower in certain areas where overlapping occurs but one pulse is not "centered" in the tranverse (width) dimension of the line, with respect to the previous pulse. The unduly narrow portion of the line of interruption then may be readily traversed by an electrical arc, as a short circuit.

A further deficiency is that U.S. Pat. No. 5,276,382 teaches the use of a functional layer of the electroluminescent lamp to provide a mask for the formation of the line of interruption by the laser. Layers that can be used as a mask include the phosphor material and the bus bar. The laser removes at least a part of the mask layer in addition to the conductive material.

Such use of a functional layer of the lamp as a mask has several disadvantages, including the potential of removing an excessive amount of an important component of the lamp, such as the phosphor material. The use of a mask could require an additional step in forming the mask, thereby adding to the expense of the lamp. The method taught in U.S. Pat. No. 5,276,382 also suffers from the drawback that it is difficult to control the exact depth of penetration (along the z-axis) of the laser energy into the underlying substrate. Only movement in the x and y axes is controlled; the control of the x axis is determined by the movement of the laser on a gantry, and the control of the y axis is determined by the movement of the table on which the subassembly to be scribed is positioned.

Mechanical devices can also be used to remove a narrow line of the conductive material to form multiple electrodes. See, for example, U.S. Pat. No. 4,534,743. One means disclosed for removing a portion of the conductive material is the application of a solvent to the material, followed by removal of the material portion with a wire brush, thereby creating a "narrow groove" in the conductive material, providing at least two laterally spaced electrodes. Alternatively, a precision saw blade may be used. The size of the narrow groove is approximately 0.127 millimeters (0.005 inch).

The method disclosed in U.S. Pat. No. 4,534,743 of wire brushing the conductive material uses the edges of the wire brush to remove the conductive material, with the bristles of the wire brush being perpendicular to the axis of the shaft of the tool used to direct the brush. The patent describes the use of a shielding device to construct a thin line cut, and to protect the functional rear electrode material. This method, however, may undesirably result in removing material at different depths, since it is difficult to control the edges of the brush with precision. This in turn can cause damage to the underlying substrate, thereby weakening the lamp. Further, the narrow groove formed by the wire brushing could permit an electric arc to traverse the groove, thereby causing a short circuit.

Another technique for removing a portion of the conductive material on an electrode is disclosed in U.S. Pat. No. 5,223,687. This patent teaches the creation of a fine pattern on the electrode, thereby creating multiple electrodes suitable for illuminating multiple lighted areas within a liquid crystal display. A metal electrode is employed, having a needle-like tip through which a voltage is applied between such metal electrode and the conductive material, thereby etching a narrow groove in the conductive material. The size of the area in which the conductive material is removed extends up to 10 microns around the contacting area.

A metal electrode with multiple needle-like tips may be used to create parallel lines extending across the electrode, in which conductive material is removed. The drawbacks to this approach include the difficulty of accurately controlling an electrode with a small needle tip that concentrates the electric charge, as well as removing the resulting scattered etched particles from the electrode substrate. Furthermore, the use of significant voltages may create safety hazards. In addition, the removal of an area of the conductive material which is 10 microns in width, of itself may not prevent electrical arcing, and consequently such processing may still result in significant risk of short-circuiting in the use and operation of the lamp constructed from such electrode.

Another approach for removing an area of conductive material is disclosed in U.S. Pat. No. 4,745,334. This patent teaches cutting out a portion of the rear electrode in the vicinity of the area in which lead terminals are attached to the front electrode of the lamp. The lead terminals are attached using a printed board. This method is employed in order to apply heat to the terminals of the lamp at an area distant from the lamp. This method requires the removal of a portion of the entire front electrode layer and supporting substrate, e.g., polymeric film. Accordingly, the portion of the lamp article having the front electrode cut away introduces a significant variation in thickness to the lamp, which may be detrimental from a packaging or aesthetic standpoint. Further, the cutting operation introduces a processing step which increases the complexity of the manufacturing process, and which may result in damage to the metal coating incident to the severing of the portion to be excised, in connection with the stresses thereby imparted to the electrode layer at distances beyond the cut-out portion. Such stresses may result in delamination of the metal film on the substrate, with consequent adverse effect on the performance of the resultant lamp article.

Thus, the various prior art approaches to the removal of a portion of the conductive material on an electrode entail numerous disadvantages in the production of an electroluminescent lamp.

The present invention is directed to, inter alia, an improved electroluminescent lamp and appertaining method of manufacture that overcome many of the disadvantages of the lamps of the prior art.

SUMMARY OF THE INVENTION

In a broad aspect, the invention relates to an electroluminescent lamp article, comprising an electrode layer including a substrate with a main surface (e.g., top or bottom surface of a planar substrate member of selected thickness) which has been coated with a film of a conductive material, e.g., metal or a conductive polymer, intermetallic material, etc., with a region of the surface of the substrate wherein the conductive material film has been removed from the substrate surface by rotary abrasion.

The invention contemplates the use of rotary abrasion to remove the conductive material, e.g., substantially all, or at least a short-circuit attenuating portion thereof, on a predetermined region of the electrode layer which has been previously coated with the conductive material, e.g., metal, conductive polymer, intermetallic composition, or other suitable conductive material. The predetermined region may be a lead attachment region, and/or it may comprise an edge or marginal region of the electrode layer, for edge isolation of the lamp's conductive electrode, to attenuate or minimize the occurrence of edge shorting incident to the handling or contact with the edges of the electroluminescent lamp comprising such isolation structure. Edge isolation, in addition to its other beneficial aspects, serves to improve high humidity resistance of the lamp, thereby improving lamp life and durability.

The present invention thus relates in one aspect to an electroluminescent lamp comprising an electrode layer which includes a conductive material film coated over the surface of a substrate, with a lead attachment region wherein the conductive material film has been removed from the substrate surface by rotary abrasion.

The invention relates in another specific aspect to an electroluminescent lamp comprising an electrode layer which includes a conductive material film coated over the surface of a substrate, with an edge isolation region wherein the conductive material film has been removed from the substrate surface by rotary abrasion.

In another aspect, the invention relates to a method for manufacturing an electroluminescent lamp comprising an electrode layer which includes a conductive material film coated over the surface of a substrate, the method comprising removing a region of the conductive material by rotary abrasion.

Other aspects, features and embodiments of the invention will be more fully apparent from the ensuing disclosure and appended claims.

DETAILED DESCRIPTION OF THE INVENTION

Figure 1:
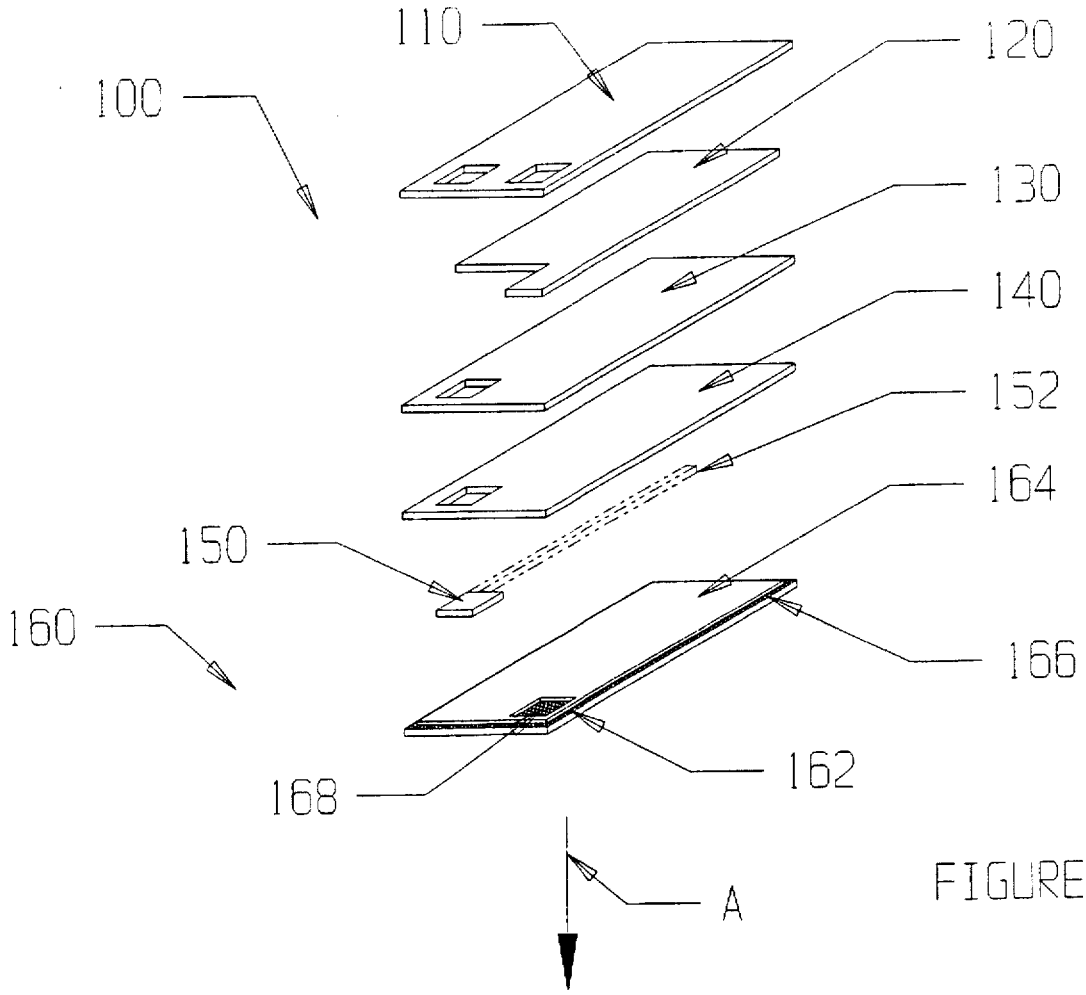
FIGS. 1 is a perspective schematic representation of the individual layers of an electroluminescent lamp assembly, in exploded relationship to one another.

The present invention overcomes the drawbacks of the prior art, as described in the "Background" section hereinabove, by providing improved electroluminescent lamps and methods for making the improved lamps.

The lamps of the invention have a reduced likelihood of short circuiting and an enhanced safety character.

The electroluminescent lamp of the invention suitably comprises a front electrode layer, a rear electrode layer, and disposed between these electrode layers, phosphor material and a dielectric layer. The terms "front" and "rear" in relation to the electrodes and electrode layer structures of the invention, are employed herein in reference to the light emitting (illumination display) surface of the lamp article as the "front" face or side of the lamp, and the opposite surface as the "rear" face or side of the lamp.

In accordance with the invention, the electroluminescent lamp comprises an electrode layer which includes a conductive material film coated over the surface of a substrate, with a region, e.g., a lead attachment region and/or edge isolation region wherein the conductive material film has been removed from the substrate surface by rotary abrasion. The aforementioned region thus is defined by at least partial, and preferably substantial, absence of the previously coated metal film, as removed by the rotary abrasion. Where such region is a lead attachment region, the lead attachment region may for example have a width at least about 0.10 inch, and may for example have a block or patch conformation in the otherwise continuous conductive material film on the substrate of the electrode layer. Where such region is an edge isolation region, the width dimension of the region may also be on the order of at least 0.10 inch, which, when the electrode and other layers of the lamp are formed as sheets of a multilaminate assembly, from which individual lamps are cut in subsequent processing, is measured prior to cutting the lamp from the precursor laminate.

As used herein, the term "rotary abrasion" means a mechanical abrasion of the conductive material film on the substrate of the electrode layer by a solid abrasive element which is being rotated and while under rotation is contacted with the conductive material film on the substrate, preferably with the axis of rotation of the solid abrasive element being generally perpendicular (e.g., at an angle to the plane of the surface being abraded, of between 45 and 90 degrees, more preferably between 60 and 90 degrees) and preferably substantially perpendicular, and most preferably perpendicular, to the plane of the surface being abraded.

The invention contemplates the use of rotary abrasion to remove the conductive material, e.g., substantially all, or at least a short-circuit attenuating portion thereof, on a predetermined region of the electrode layer which has been previously coated with the conductive material, e.g., metal, conductive polymer, intermetallic composition, or other suitable conductive material, etc. The predetermined region may for example be a lead attachment region to attenuate or minimize the occurrence of short-circuiting in consequence of the lead attachment and appertaining connector structure, and/or the predetermined region may comprise an edge or marginal region of the electrode layer, for edge isolation of the lamp's conductive electrode, to attenuate or minimize the occurrence of edge shorting incident to the handling or contact with the edges of the electroluminescent lamp comprising such isolation structure.

The invention contemplates methods of manufacturing electroluminescent lamp articles involving rotationally abrading and thereby removing conductive material on an electrode layer comprising such conductive material on a substrate. The region of removed conductive material may comprise a block or patch of dematerialized (i.e., devoid of the conductive material) surface on the substrate at least about 0.10 inch wide. Preferably, the length of such region is at least equal to its width dimension, and the region may for example comprise a circular demetallized or dematerialized surface on the substrate, or any other shape, e.g., square, rectangular, oblong, polygonal, etc., depending on the shape and extent of travel of the abrasion element on the conductive material surface for removal of the conductive material from the substrate. When the region of removed conductive material is an edge isolation region at the edge, or margins of the electrode layer, the length of the region typically will be substantially greater than the width of such region, and may for example be equal to the length of the electroluminescent lamp, running along the entire length of the lamp's edge or margin, or across the width of the lamp.

The materials and construction of an electroluminescent lamp in which the structure and method of the invention may be employed are described, for example, in U.S. Pat. No. 5,276,382, which is incorporated by reference herein in its entirety, although it is to be recognized that the lamp of the invention may be widely varied in its structure and component materials, within the skill of the art.

Preferably, the lamp is a thin, flexible, multi-layered assembly formed by coating or otherwise depositing the layers of the lamp on a large base panel, followed by cutting out the individual lamps from the panel. Flexible lamps are preferably formed in rectangular shape, although any suitable shape or conformation may be employed. Preferably, there are registration targets or indicia in the panel for the purpose of orientation within the panel and from one panel to the next. See, for example, FIGS. 5–9, described more fully hereinafter, which show registration holes 290 cut in the base panel and registration targets 195 used for alignment.

In preferred embodiments of the present invention, the lamp may be from about 0.006 to about 0.030 inch thick, and most preferably, the lamp is on the order of about 0.012 inch thick, although the thickness and other dimensions of the lamp may be widely varied in the broad practice of the invention. The lighted area of the lamp is desirably maximized within the overall dimensional constraints of the given lamp article, and is desirably at least as large as the rotary abrasion dematerialized area of the lamp.

The overall lighted area of the lamp may optionally comprise multiple, constituent lighted areas within one lamp, and each lighted area may optionally be individually activated, and may optionally have different light color illumination areas. Lamps may generate light of a single color or the lamp may be constructed so that different regions of the lighted area of the lamp generate light in respectively different colors. In preferred embodiments, the rear electrode is opaque so that light is emitted only from the front surface of the lamp.

Lamp articles according to the present invention may entail a variety of constructions, shapes, sizes and conformations, as may be necessary and/or desirable in a given end use application of such lamps. The product lamp article may be encased in a moisture-resistant envelope of Aclar® polymer or other useful material of suitable low moisture permeability characteristics, as a so-called encapsulated lamp or packaged lamp. Alternatively, and preferably, the product lamp article of the invention may be of an unpackaged design as hereinafter shown and described with reference to FIGS. 1–5 hereof.

FIG. 1 shows an electroluminescent lamp 100 according to one embodiment of the present invention, comprising the following constitutent layers: a moisture barrier layer 110, rear electrode 120, dielectric layer 130, phosphor layer 140, front lead pad 150 connected to optional busbar 152, and front electrode layer 160. The front electrode layer 160 comprises a base substrate 162 having a conductive material film 164 coated thereon, which has been processed in accordance with the rotary abrasion method of the invention to form a lead isolation area 168 and an edge isolation area 166 as dematerialized regions of the conductive material film exposing the base substrate 162 as shown.

In this lamp assembly as shown and oriented in FIG. 1, the light emitting side of the lamp article is the bottom face of the front electrode layer 160, which in operation emits light in the direction generally indictated by arrow A in the drawing.

Figure 2:
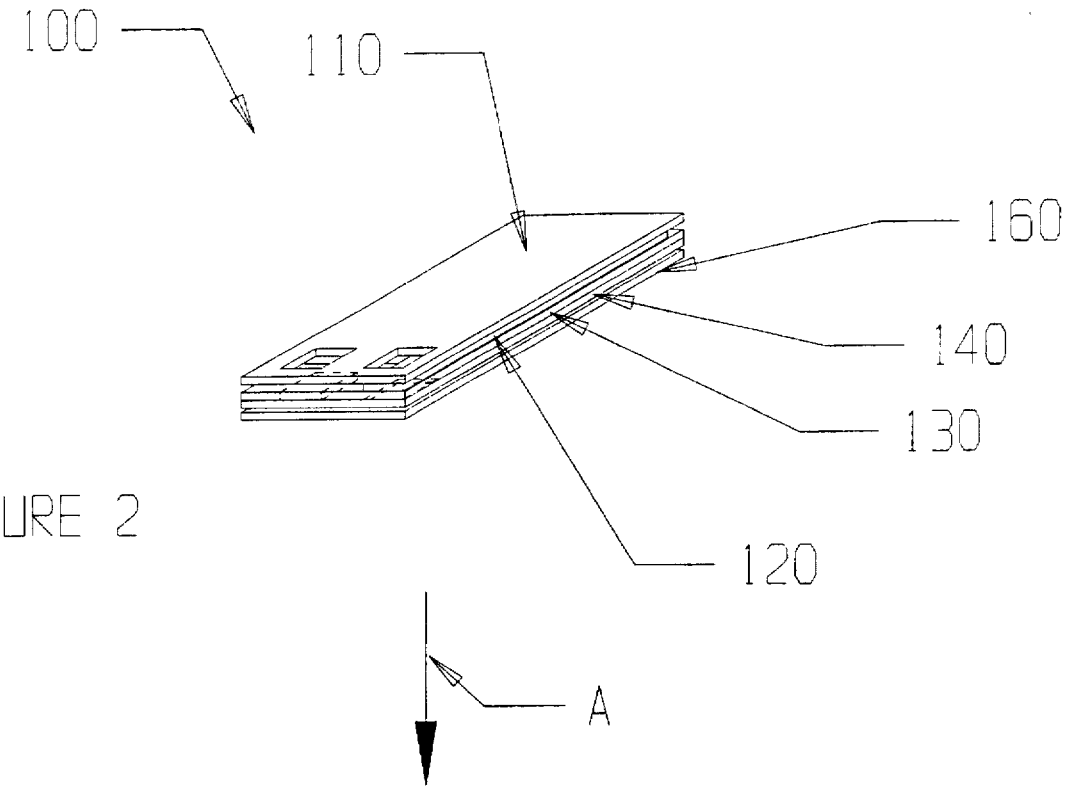
FIG. 2 is a perspective simplified schematic view of the assembled electroluminescent lamp whose constituent layers are shown in FIG. 1.

The assembled lamp article 100 is shown in FIG. 2.

Figure 3:
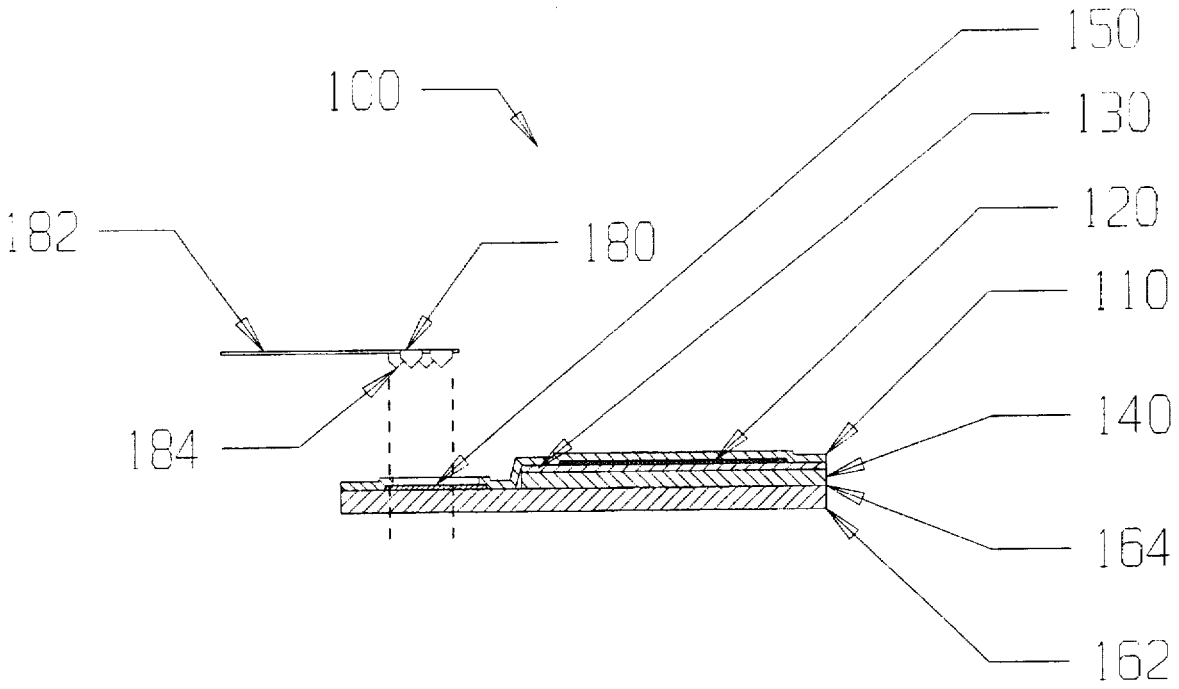
FIG. 3 is a cross-sectional elevation view of an end portion of the electroluminescent lamp assembly of FIGS. 1 and 2, showing the front lead crimp connector in exploded relationship to the main structure of the lamp.

FIG. 3 is a cross-sectional elevation view of an end portion of the electroluminescent lamp assembly 100 of FIGS. 1 and 2, showing a front lead crimp connector 180 in exploded relationship to the main structure of the lamp. The front lead crimp connector 180 comprises lead element 182 and multiple tines 184, and engages the front lead pad 150 and the front electrode 162. The front lead crimp connector is joinable by means of lead element 182 to a suitable power supply (not shown).

Figure 4:
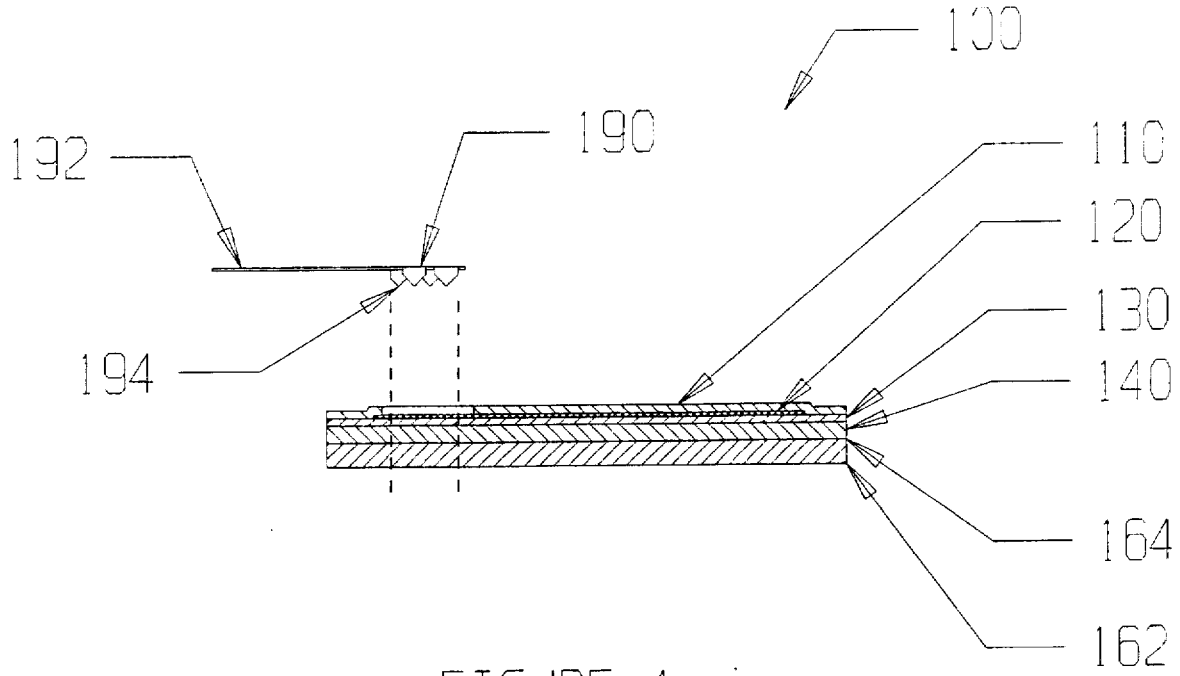
FIG. 4 is a cross-sectional elevation view of an end portion of the electroluminescent lamp assembly of FIGS. 1 and 2, showing the rear electrode crimp connector in exploded relationship to the main structure of the lamp.

FIG. 4 is a cross-sectional elevation view of an end portion of the electroluminescent lamp assembly 100 of FIGS. 1 and 2, showing the rear electrode crimp connector 190 in exploded relationship to the main structure of the lamp. The rear electrode crimp connector 190 comprises lead element 192 and multiple tines 194, and engages the rear electrode 120. The rear electrode crimp connector 190 is joinable by means of lead element 192 to the power supply (not shown), in circuit relationship to the power supply with lead element 182 electrically connected to the front lead pad 150 and the front electrode 162.

The fabrication of an electroluminescent lamp according to the present invention may be carried out as follows. Beginning with the construction of the translucent front electrode, conductive material is placed on a substrate. The conductive material is preferably a transparent conductive material such as indium tin oxide (ITO), indium oxide, aluminum, gold, silver, palladium, nickel, inconnel, platinum, ruthenium, or other metal oxides, metals, conductive polymers, intermetallic compounds, etc. The ITO is a preferred conductive material, and is preferably vacuum deposited to provide a continuous coating extending across the entire substrate to form a transparent film, preferably from about 500 to 1200 Angstroms in thickness, and more preferably about 1000 Angstroms thick. Alternatively, for example, a translucent grid can be used for the front electrode.

The lamp optionally includes a front lead pad and a bus bar. The front lead pad is a conductive pad placed in the area where the front lead connects to the lamp, and serves to protect the conductive front electrode material from a crimping, piercing or pressure pad connection as employed for subsequent lead attachment. The optional bus bar assists in the current-carrying ability of the conductive front electrode material in a lamp having an extended length, for example, and serves to distribute power across the front of the lamp.

The optional bus bar is preferably attached to a lead pad, and it can be layered over the front electrode. The optional bus bar can be layered before the application of conductive material on the front electrode substrate, or after the removal of conductive material from the front electrode substrate. The front lead pad and bus bar are preferably formed by screen printing a conductive ink, comprising a conductive component such as silver, aluminum, nickel, carbon, palladium, copper, graphite, gold, etc., in flake, particle, or other suitable form, dispersed in a polymeric resin carrier and solvent formulation, over the conductive material of the front or rear electrode. The solvent can then evaporated, for example, by placing the panel in an oven, thereby leaving behind a solid film which forms the front lead pad and optional bus bar, or the conductive material film can be otherwise formed and/or cured in an appropriate manner depending on the specific conductive material employed. The bus bar layers in the general practice of the invention may for example be from about 0.020 to about 0.15 inch wide, on the order of about 0.0005 inches thick, and may be suitably placed at any suitable locations on the lamp for electrical coupling with associated electrodes, with recognition that the busbar is opaque and will occlude light emission from the lamp if placed over any light emitting portion.

Next, in accordance with the present invention, at least one region of electrical discontinuity is formed in the conductive material of the front main body electrode, preferably in the area in which the rear lead terminal 190 is attached, and/or the edge or marginal regions of the conductive material film layer. These electrical discontinuity region(s) 166 are formed according to the present invention using mechanical rotary abrasion.

The rotary abrasion processing is carried out so that at least a portion of the electrode substrate surface (formerly overcoated with the conductive material layer) is at least partially devoid of conductive material, being rotationally abradingly "dematerialized" of such conductive material, to such extent as to obstruct the flow of electricity to this area of the front electrode.

The entire surface area of the conductive material on the selected region (e.g., for lead attachment and/or for edge isolation) need not be completely removed, so long as the region of removed conductive material serves to obstruct the flow of electricity. Preferably, the periphery of such region is at least substantially, and preferably is completely, devoid of conductive material. For a region of such type having conductive material within it that is not abradingly removed, the conductive material is preferably located inside the periphery of the region, and more preferably, in approximately the center of the region.

In preferred embodiments, at least about 40% of the area of the rotationally abraded region is devoid of conductive material. For example, if the abraded region measures 0.40 by 0.48 inches, the area of the region is 0.19 square inches, and the portion of the region absent conductive material is at least about 0.08 square inches.

More preferably, at least about 50% of the area of the region is absent conductive material; even more preferably, at least about 60%; even more preferably, at least about 70%; even more preferably at least about 80%; even more preferably at least about 90%; and most preferably at least about 95% of the area of the rotationally abraded region is absent conductive material. In most preferred embodiments, the percentage of the area of the rotationally abraded region absent conductive material is about 100%.

In preferred embodiments, the mechanically rotationally abraded area corresponds to the region in which a lead terminal is attached, and/or which forms an edge isolation area in the product lamp article. This mechanically rotationally abraded area is not a thin line or a narrow groove, but is rather of substantial dimensional extent, e.g., having a dimension in each of the x and y directions of at least 0.10 inch (the x dimension being parallel to the end edges of the lamp, and the y dimension being parallel to the longitudinal edges of the lamp, when the lamp is of square or rectangular shape).

The phrase "absent conductive material" as used herein means substantially devoid of conductive material. Preferably, a region of the substrate that is substantially devoid of conductive material has at least about 90% of the conductive material removed; more preferably, at least about 95% of the conductive material removed; and most preferably, about 100% of the conductive material is removed. For example, in an electrode structure comprising a polymeric substrate having coated thereon a film of ITO, a mechanically rotationally abraded area "absent conductive material" may have about 10% or less of the ITO film residue (relative to that originally coated on the substrate) on such area.

For those embodiments in which the mechanically rotationally abraded area is used to electrically isolate the attachment of the electrodes to electrical contacts, the mechanically rotationally abraded area may be shaped, for example, in a circle or oval or ellipse. Alternatively, the mechanically rotationally abraded area may have at least three sides, and it may be, for example, in the shape of a square or a rectangle. None of the sides of the block need be equal in size and the mechanically rotationally abraded area need not be symmetric.

The mechanically rotationally abraded area may have an edge of the lamp as one or more of its borders. Alternatively, the mechanically rotationally abraded area may be positioned in a location of the electrode that is spaced inwardly from the edges of the lamp.

Figure 5:
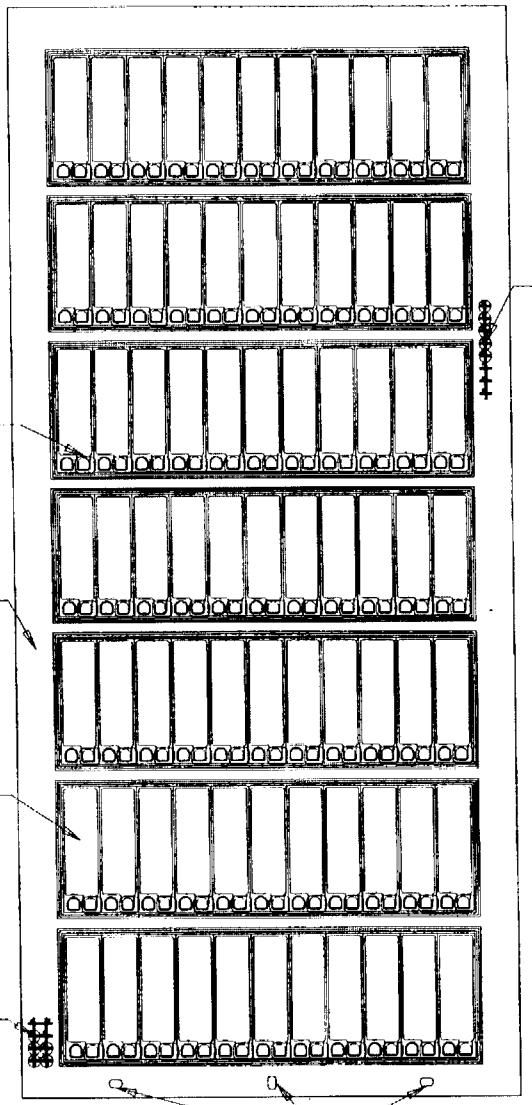
FIG. 5 is a schematic representation of a panel of electroluminescent lamps made according to one embodiment of the present invention in which rotary abrasion removal of a metal film from the electrode layer has been carried out to form a lead attachment region on the substrate of the electrode layer.
Figure 6:
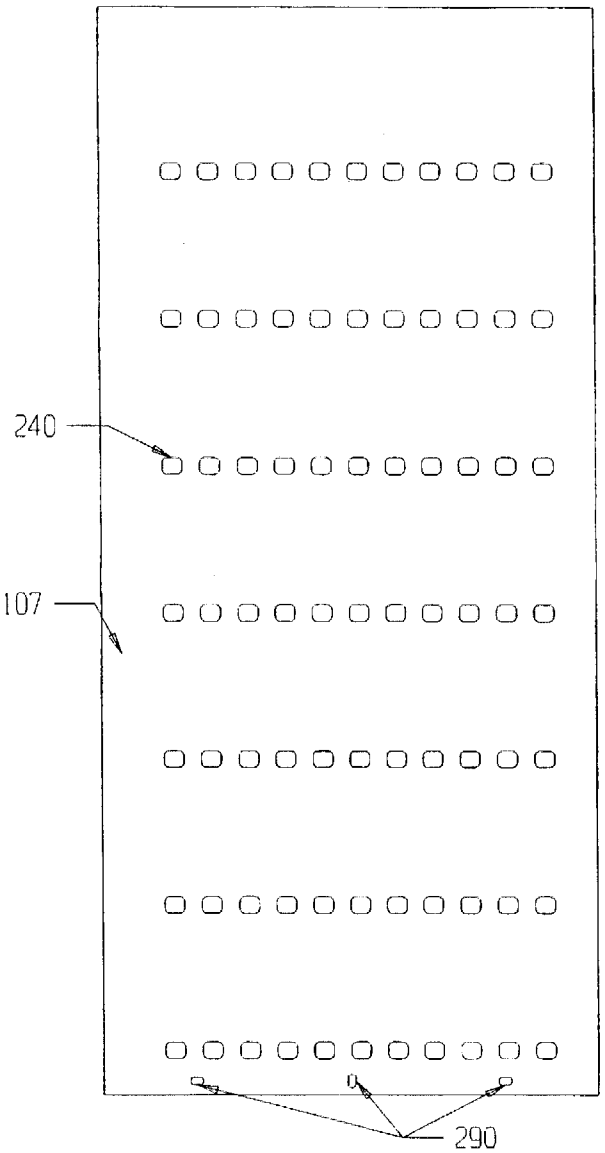
FIG. 6 is a schematic representation of the panel of lamps in FIG. 5, showing the lead attachment regions formed on the substrate by rotary abrasion of the metal film on the substrate.

See, for example, FIGS. 5 and 6 which illustrate a panel 107 of lamps 109 with mechanically rotationally abraded areas formed according to the present invention. In FIG. 5, a panel of seventy-seven lamps are shown, all of which have a mechanically rotationally abraded area 240 formed by rotary abrasion. A pattern of the abraded areas 240 formed by rotary abrasion in the seventy-seven lamps is shown in FIG. 6.

For those embodiments in which the mechanically rotationally abraded region is used to electrically isolate the attachment of the electrodes from electrical connectors, the mechanically rotationally abraded region is preferably about 0.10 to about 1.00 inches wide by about 0.10 to about 1.00 inches long. If the block is circular in shape, preferably the diameter is from about 0.10 to about 1.00 inches.

In general, the selected size of the mechanically rotationally abraded area will depend upon the application of the lamp and the size of the tip of the abrasive tool. All of the dimensions of the mechanically rotationally abraded area are determined by control of the x, y and z axes during rotary abrasion.

The mechanically rotationally abraded area can be located anywhere on the electrode except in the area of the front lead pad and the optional bus bar. In certain embodiments, the mechanically rotationally abraded area is preferably in an electrical lead attachment area for the rear electrode.

The minimum size of the mechanically rotationally abraded area depends primarily upon the size of the tip of the abrasive tool. The maximum size of the mechanically rotationally abraded area depends primarily on the functional character of the abraded area in the final lamp product, e.g., as a lead attachment area, or as an edge isolation area, and the necessity of providing a maximal lighted area in the product lamp. The depth of the mechanically rotationally abraded area depends primarily upon the vertical pressure applied to the abrasive tool. Thus, the depth of the area to be abraded can be readily controlled by the z-axis force applied to the abrading tool in contact with the conductive material film being abraded. Preferably, the depth of the block is approximately equal to the depth of the conductive material on the electrode layer. The depth of the block may be larger than the depth of the conductive material. Preferably, the depth of the mechanically rotationally abraded area is selected so that only a minimal portion of the substrate is abraded, thereby preventing the lamp from being weakened or otherwise structurally compromised. In preferred embodiments, the depth of the block typically is less than about 0.001 inches.

For lead attachment, the mechanically rotationally abraded area is preferably at least about 0.10 inches wide. In certain preferred embodiments, the mechanically rotationally abraded area is about 0.10 inches wide. In other embodiments, the block is at least 0.13 inches wide, and more preferably at least 0.15 inches wide. In certain other preferred embodiments, the block is preferably at least about 0.20 inches wide. In still other embodiments, the block is preferably at least about 0.40 inches wide, more preferably at least about 0.50 inches wide, and most preferably at least about 1.00 inches wide.

For shapes of the mechanically rotationally abraded area having a width and a length, the length of the mechanically rotationally abraded area need not be equal to the width of the mechanically rotationally abraded area. Preferably, the mechanically rotationally abraded area is at least about 0.10 inches long. In preferred embodiments, the mechanically rotationally abraded area is at least about 0.13 inches long, more preferably at least about 0.15 inches long, still more preferably at least about 0.20 inches long, and most preferably at least about 0.40 inches long. In further embodiments, the mechanically rotationally abraded area is at least about 0.5 inches long, and more preferably at least about 1.00 inches long. The selected size of the mechanically rotationally abraded area will depend upon the application of the lamp. The length of the mechanically rotationally abraded area depends on the selected size and function of the area to be abraded and the size of the tip of the abrasive tool, it being understood that the size and dimensions of the mechanically rotationally abraded area may be widely varied in the broad practice of the present invention.

In further embodiments of the present invention, a wide channel mechanically rotationally abraded area is created to electrically isolate an edge or edges of the lamp. A "wide channel" is defined as an elongate region of the electrode absent conductive material, which serves to obstruct the flow of electricity in this region. The wide channel may for example be in the shape of an elongate region with linear parallel sides and with rounded end edges.

Figure 7:
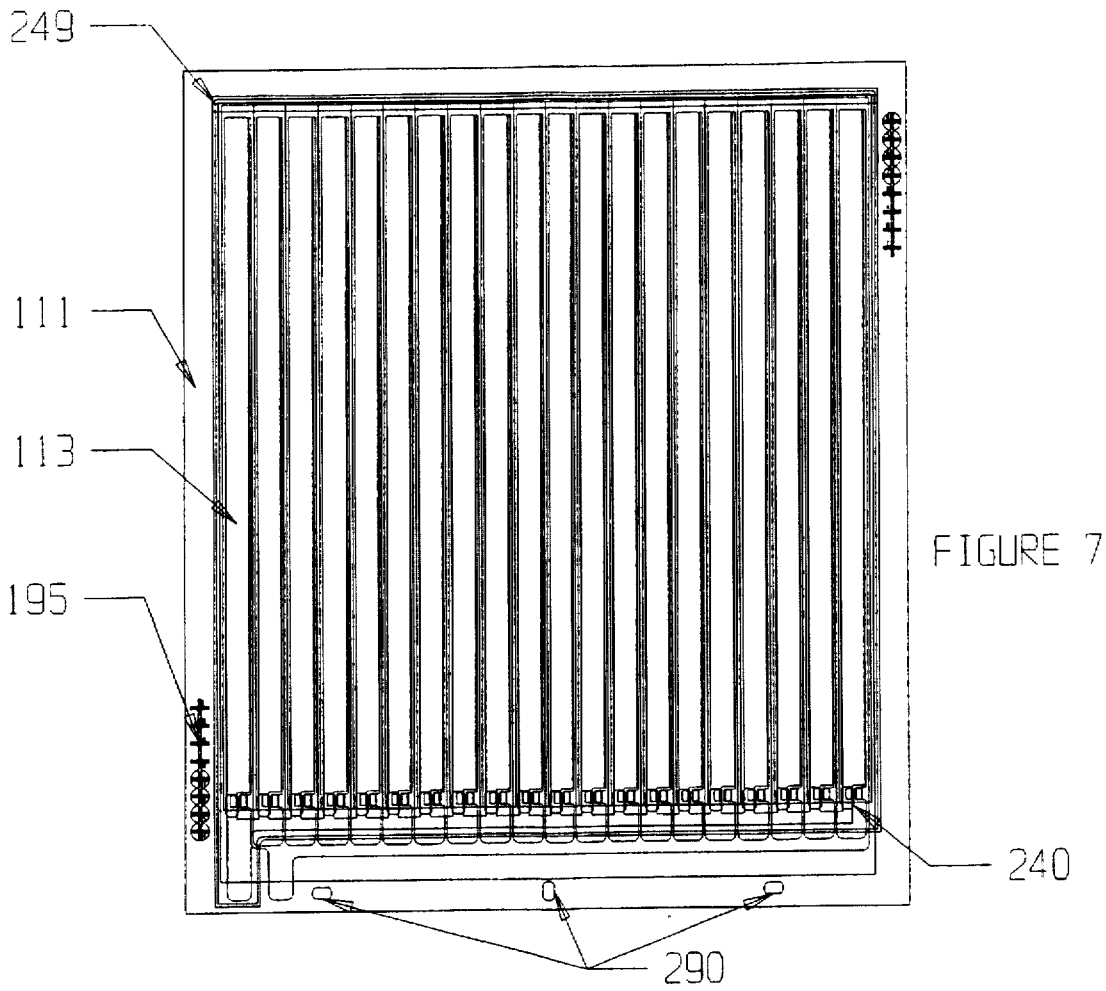
FIG. 7 shows a schematic representation of a panel of lamps made according to another embodiment of the invention in which rotary abrasion is employed to form an edge isolation region, as well as a lead attachment region, on the substrate of the electrode layer.
Figure 8:
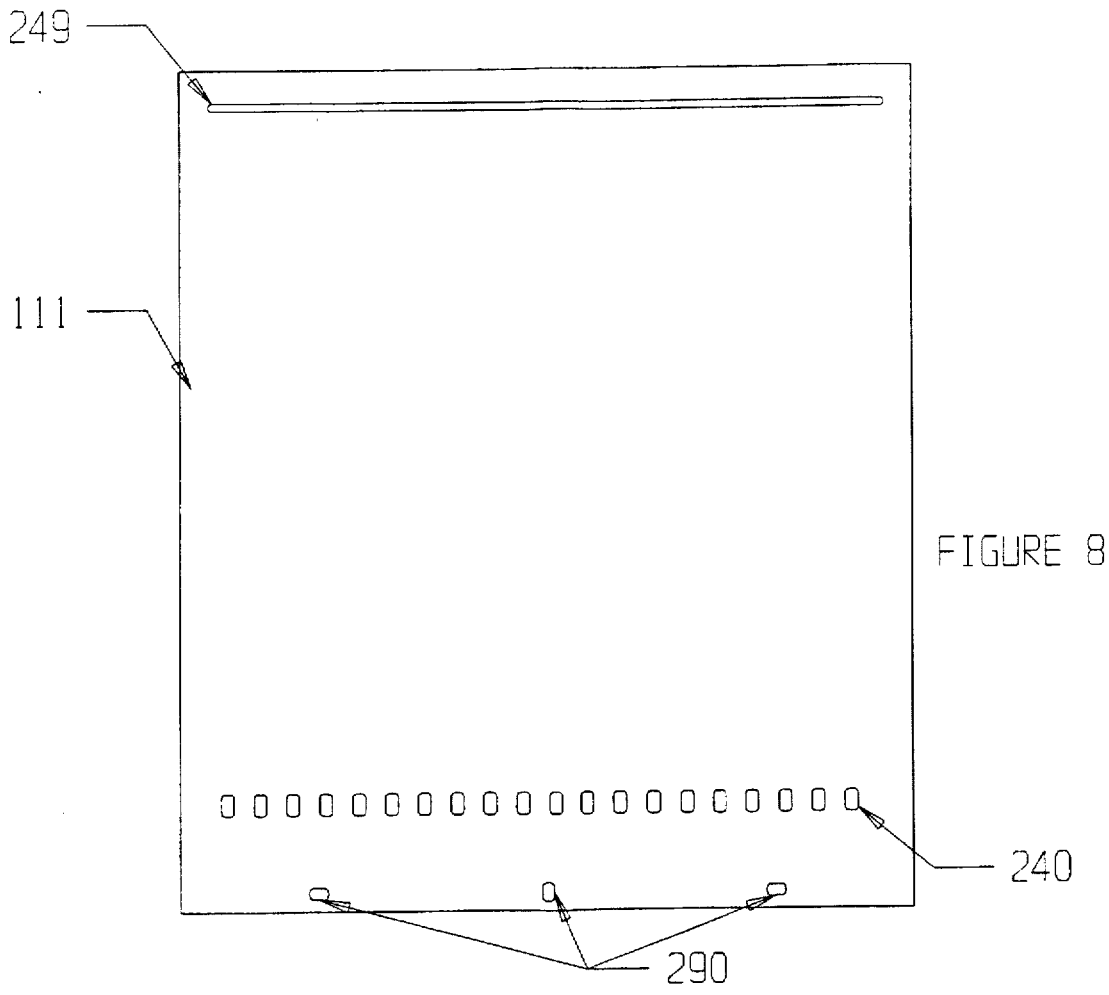
FIG. 8 is a schematic representation of the panel of lamps in FIG. 7, showing the edge isolation region and the lead attachment region formed on the substrate by rotary abrasion of the metal film on the substrate.

See, for example, FIGS. 7 and 8 which illustrate a panel 111 of lamps 113 with mechanically rotationally abraded areas 240 for lead attachment and mechanically rotationally abraded area wide channels 249 for edge isolation, formed according to the present invention. In FIG. 7, a panel of twenty lamps 113 is shown, all of which have a mechanically rotationally abraded lead attachment area 240 formed by rotary abrasion, and a mechanically rotationally abraded wide channel 249 formed on one edge of the lamp. The wide channel 249 is divided so that it is present on each lamp after the individual lamps are cut from the substrate. The pattern of the abraded regions 240 and wide channels 249 formed by rotary abrasion in the panel 111 of twenty lamps is shown in FIG. 8.

Figure 9:
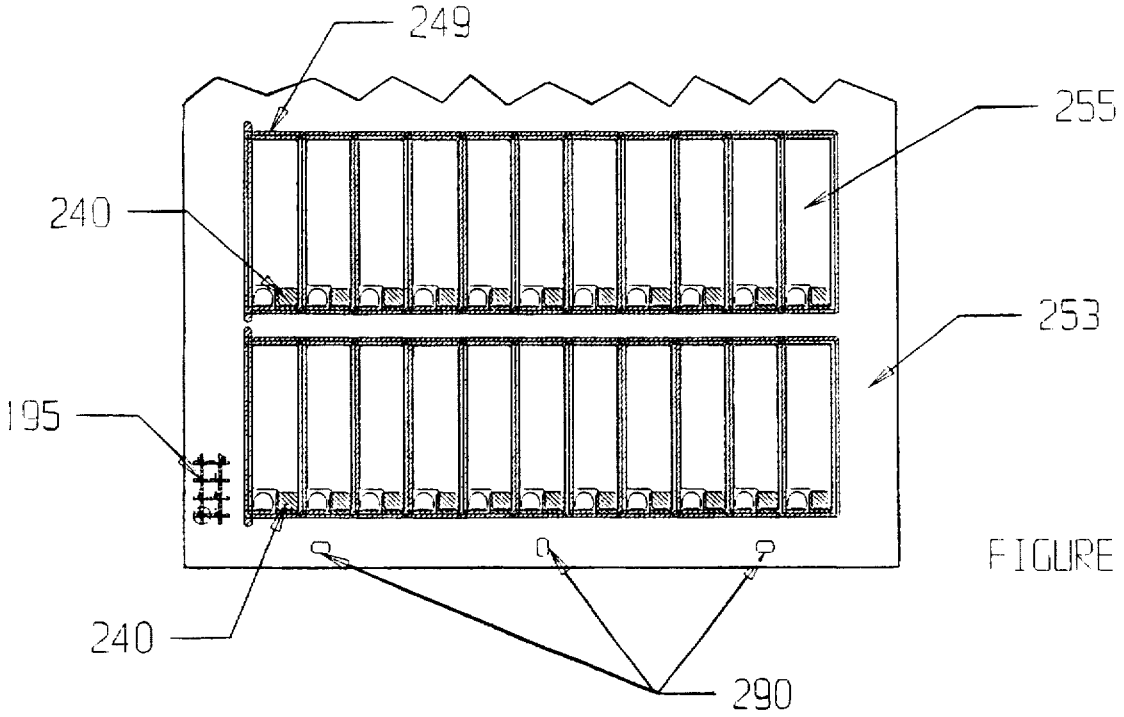
FIG. 9 shows a schematic representation of a panel of lamps made according to an embodiment of the present invention, in which rotary abrasion is employed to form an edge isolation region, as well as a lead attachment region, on the substrate of the electrode layer.
Figure 10:
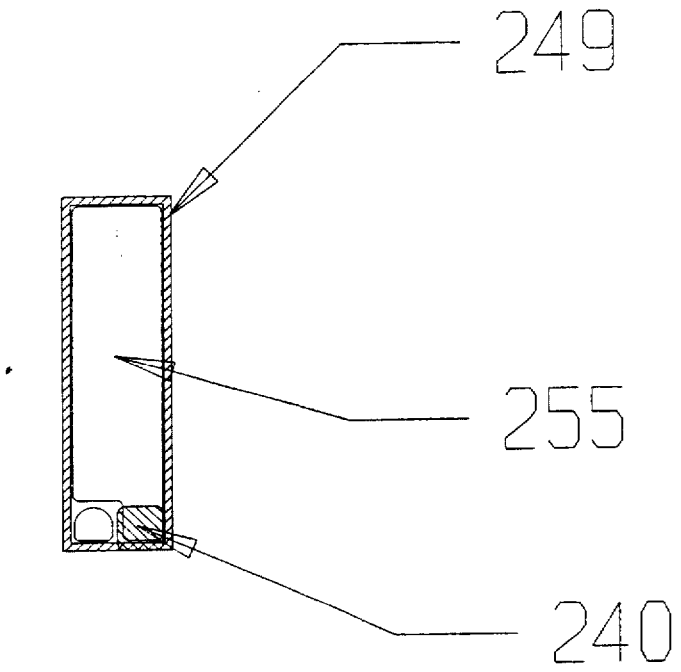
FIG. 10 is a schematic representation of a single lamp cut out from the panel of lamps shown in FIG. 9.

FIG. 9 shows schematically another panel 253 of lamps 255 according to the present invention, each having a mechanically rotationally abraded lead attachment area 240 formed by rotary abrasion, and a mechanically rotationally abraded wide channel 249 on every edge of the lamp. The wide channel 249 formed by rotary abrasion of the electrode is cut in half upon cutting out the individual lamps so that each lamp 255 has the appearance shown schematically in FIG. 10.

For those embodiments in which the wide channel is used to electrically isolate the edge or edges of the lamp, the wide channel of an individual lamp is preferably at least about 0.05 inch wide, and more preferably at least about 0.10 to about 1.00 inch wide. In preferred embodiments, the wide channel is at least about 0.10 inch wide, in certain other preferred embodiments, the wide channel is at least about 0.13 inch wide, more preferably at least about 0.15 inch wide, and most preferably at least about 0.20 inch wide. In other embodiments, the wide channel is preferably at least about 0.40 inch wide, more preferably at least about 0.5 inch wide, and most preferably at least about 1.00 inch wide.

As shown above in reference to FIG. 9, a wide channel 249 can be abraded in an area of the substrate panel 253 that covers two adjacent lamps 255, which are subsequently cut out, thereby severing the wide channel so that its width on an individual lamp is half of the original width on the substrate.

The length of the wide channel is preferably at least about 0.10 inch, and more preferably as long as the length of the edge of the lamp itself. The wide channel may optionally be continuous for more than one edge of the lamp, and it may optionally be continuous for the entirety of all the edges of the lamp, i.e., about the entire perimeter of the lamp. The wide channel preferably extends to the actual edge extremity of the lamp, thereby providing lamp edges absent conductive material which due to the non-conductive character of the (front) electrode substrate or base layer (which may comprise non-conductive polymer, plastic, or other non-conductive material) presents a reduced edge-shorting hazard.

In certain preferred embodiments, the unlighted edges of the lamp are from 0.020 to about 0.25 inch wide, and more preferably, the unlighted edges of the lamp are from about 0.050 to about 0.12 inch wide.

The size and thickness of the abrasive tip of the tool may optionally be used to determine the area and depth of the abraded region, the abraded region being a block or patch for lead attachment or a wide channel for edge isolation. In general, the selected size of the mechanically rotationally abraded area will depend upon the application of the lamp and the size of the tip of the abrasive tool, and all of the dimensions of the mechanically rotationally abraded area are readily determined by control of the x, y and z axes during rotary abrasion.

Preferably, the depth of the wide channel is approximately equal to the depth of the conductive material on the substrate. The depth of the wide channel may be larger than the depth of the conductive material. Preferably, the depth of the wide channel is selected so that only a small portion of the substrate is abraded, thereby preventing the lamp from being weakened. In preferred embodiments, the depth of the wide channel is less than about 0.001 inches.

In some applications within the broad scope of the present invention, it may be desirable to abrade the mechanically rotationally abraded area through multiple layers, such as a layer containing phosphor material, in addition to the abrasion of the conductive material on the (front) electrode layer substrate.

Rotary abrasion in the practice of the invention involves rotational motion about an axis causing friction and wearing away the conductive material on the substrate being abraded. Rotary abrasion may be usefully achieved using an abrasive tipped tool. The tip may have any shape, and preferably it is round with a flat plane shape. Preferably, the tip has a diameter from about 0.10 to about 1.00 inches. The tool is preferably spring loaded. A rigidly attached tool may be used, however, a spring loaded tool is preferred since it is less likely to cause damage to the substrate in the event of overselection of bearing pressure on the abrasive tool.

Preferably, the tool is rotated at a speed ranging from about 5,000 to about 35,000 revolutions per minute. The tool is advantageously controlled by a computerized numerical control (CNC) machine, which is programmed to move the tool in a coordinated manner in x, y, and z axes to form the mechanically rotationally abraded area. The CNC machine can be programmed to create a mechanically rotationally abraded area in various locations of the electrode, and in various selected sizes and shapes. Additionally, the tool attached to the CNC machine can be used, for example, for the manufacture of multiple lamps in a single sheet.

The substrate preferably is positioned on a flat surface of a table for use with the CNC machine. The flatness of the table relative to the z axis, which determines the depth of the abrasion, is important for consistency of depth of the abrasion. Specifically, a flat surface is preferred so that the depth of abrasion is readily controllable for the complete removal of the conductive layer, but the depth is not so great as to cause damage to the substrate layer by abrading too deeply.

In preferred embodiments, the tool is moved along the x and z axes, and the table is moved in the y axis Typically, the use of rotary abrasion results in visually discernible striations in the abraded area of the substrate. More specifically, the pattern formed in the substrate by the use of rotary abrasion is that of circular markings about the axis of rotation of the abrading tool at the location of contact of the abrading tool with the conductive material-coated substrate layer. In certain embodiments, the circular markings are concentric circles.

The abrasive tip for use in rotary abrasion is preferably constructed of a mildly abrasive material so that the underlying substrate is only minimally abraded and therefore not substantially weakened. For example, the tip may be constructed of wool fiber felt or a synthetic fiber felt. Alternatively, for example, the abrasive tip may be constructed of an abrasively impregnated rubber stock, which can be obtained, for example, from Eraser Co. (Syracuse, N.Y.).

Preferred tools with abrasive tips that can be used to carry out a lamp fabrication method in accordance with the present invention include, for example, the following felt tipped tools having a round piece of felt with an optional hole in the center attached to a metal shaft: a 0.19 inch diameter felt tipped tool, such as the one provided by Boston Felt, Rochester, N.Y., a 0.25 inch diameter tool, a 0.38 inch diameter tool, a 0.50 inch diameter tool, and a 1.00 inch diameter tool, all of which can be obtained from Osborn Brush Co., Cleveland, Ohio; Boston Felt, Rochester, N.Y.; Spartan Felt Co., Spartanburg, S.C.; and McMaster Carr Co, Dayton, N.J. Preferably, the felt tip is from about 0.18 to about 0.40 inch thick. The abrasive tip may also be, for example, a brush, with stiff bristles that are parallel to the axis of the shaft of the tool. Preferably, the shaft of the tool is formed of metal or other rigid material of construction. The bristles of the brush preferably are about 0.18 to about 0.30 inch long. Bristle brushes that may be used in tools employed in methods of the present invention include, for example, a stiff bristle brush tool, preferably 0.19 inch in diameter, made of a metal or of a naturally occurring stiff hair, such as horse hair, as commercially available from J. S. Ritter (Portland, Me.), Foredom Brush Co. (Bethel, Conn.) Osborn Brush Co. (Cleveland, Ohio), and Dremel Co. (Racine, Wis.). Other preferred bristle brushes that may be used in tools employed in methods of the present invention include, for example, a steel brush tool that can be obtained from J. S. Ritter, Foredom Brush Co., Osborn Brush Co., and Dremel Co., and a brass brush tool that can be obtained from J. S. Ritter and Foredom Brush Co.

Additional preferred bristle brushes include a brush having plastic bristles impregnated with silicate, preferably with a 0.008 inch diameter wire, which can be obtained from Osborn Brush Co., and a brush having plastic bristles impregnated with aluminum oxide, e.g., of 600 grit character, which also can be obtained from Osborn Brush Co. Alternatively, for example, the bristles of a brush tool may be constructed of a polymer, fiberglass, or nylon. Fiberglass bristle brushes can be obtained, for example, from Eraser Co. Nylon bristle brushes can be obtained, for example, from American Brush Co. (Freeport, N.Y.).

Figure 11:
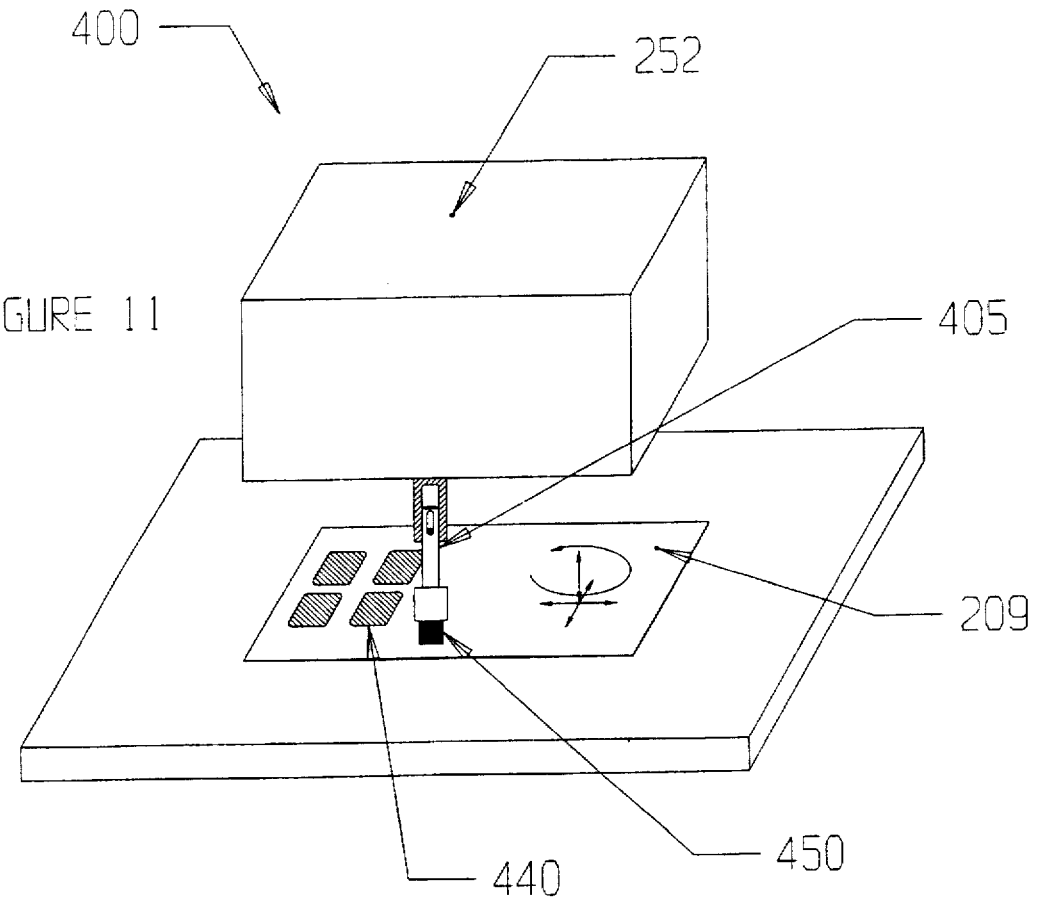
FIG. 11 illustrates a schematic representation of an apparatus for abrading the conductive material on an electrode layer in an electroluminescent lamp according to one embodiment of the present invention.

A schematic illustration of an apparatus 400 for abrading the conductive material on an electrode layer 209 of an electroluminescent lamp according to the present invention is provided in FIG. 11.

As shown in FIG. 11, a tool 405 with an abrasive tip 450 is attached to a computerized numerical control machine 252. The abrasive tip 450 is employed to rotationally abradingly remove the conductive material from the front electrode 209 leaving a mechanically rotationally abraded area 440.

Figure 12:
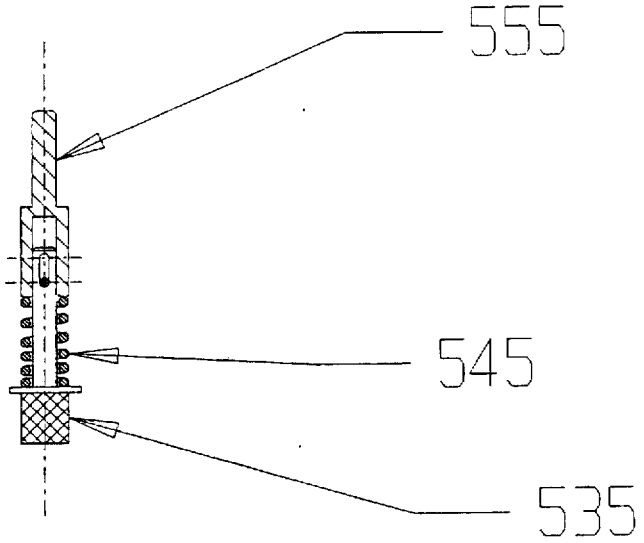
FIG. 12 shows a schematic representation of a felt-tipped tool that can be used with the apparatus depicted in FIG. 11.

FIG. 12 shows a schematic representation of a felt-tipped tool 555 that can be used with the apparatus illustrated in FIG. 11. Referring to FIG. 12, a round felt tip 535 is attached to a shaft 545 which is in turn connected to a spring-loaded tool 555 using a pin and slot connector.

Figure 13:
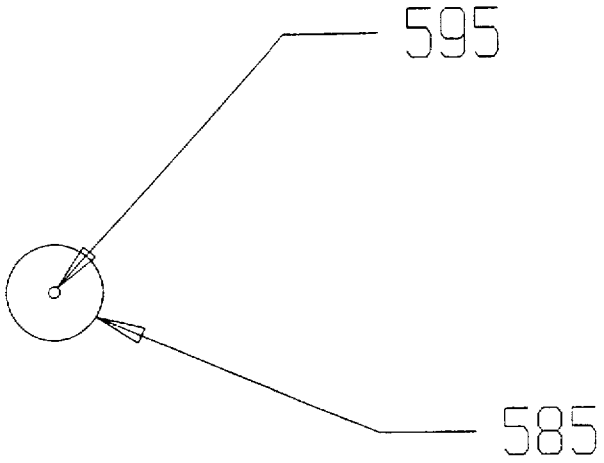
FIG. 13 is an approximate representation of a bottom plan view of the surface of the felt-tipped tool pictured in FIG. 12.

A bottom plan view of the surface of the felt-tipped tool pictured in FIG. 12 is shown schematically in FIG. 13. The surface 585 of the felt-tipped tool is used for rotary abrasion removal of conductive material from the conductive material-coated substrate. The optional hole 595 in the center of the tool may be used for attachment to the shaft 545.

Figure 14:
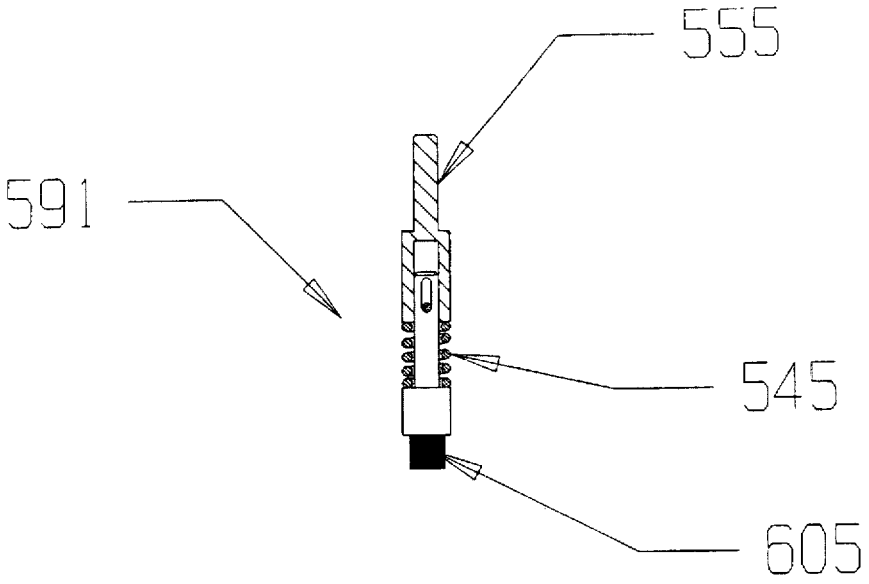
FIG. 14 is a schematic representation of a bristle brush tool that can be used with the apparatus depicted in FIG. 11.

FIG. 14 shows a schematic representation of a bristle brush tool 591 that can be used with the apparatus illustrated in FIG. 11. Referring to FIG. 14, a bristle brush tip 605 is attached to a shaft 545 which is in turn connected to a spring-loaded tool 555 using a pin and slot connector.

The use of rotary abrasion according to the present invention provides advantages that include the creation of a mechanically abraded area that imparts a wider area of electrical discontinuity, thereby decreasing the likelihood of short circuiting, for example, in the area employed for lead attachment.

Furthermore, the use of rotary abrasion according to the present invention provides for a more rapid and less expensive means for removing the conductive material, and a safer work environment, without the necessity of using laser beam-generating and control equipment, or electrically energized needles.

Additionally, the use of a mildly abrasive tool according to the present invention provides for greater accuracy and control of the dematerialized area than those methods described in the prior art.

Another aspect of the present invention that provides for greater accuracy is the control of the region of abrasion in the x, y, and z axes. Additionally, the use of the facing surface of an abrasive tool provides high levels of accuracy. Further, the mildly abrasive nature of the tips used provides for a precise mechanical means of abrasion whereby the underlying substrate is not substantially weakened. As an additional benefit of the present invention, the equipment required for rotary abrasion is readily available and relatively inexpensive.

Once the mechanically rotationally abraded area is formed according to the present invention, the electrode layer, front lead pad, and bus bar are covered with a phosphor layer, preferably by screen printing with a window above the lead pad to facilitate subsequent electrical lead connection.

To prevent moisture from penetrating the phosphor particles, the phosphors may optionally be encapsulated. The phosphor material may in some instances be dispersed within an insulating layer. The phosphor layer may for example have a thickness on the order of about 0.002 inches.

An optional next layer of a clear resin may be applied over the phosphor layer by screen printing or other suitable coating method, leaving exposed windows over the lead pads.

The next layer of the lamp is a dielectric layer, formed of a high dielectric constant material such as barium titanate which is suitably dispersed in a polymeric binder. The dielectric layer is deposited over the phosphor layer, preferably by screen printing, leaving a window over the front lead pad. Preferably, the dielectric layer is about 0.001 inch thick.

An optional next layer of a clear resin may be applied over the dielectric layer by screen printing or other suitable coating method, leaving exposed windows over the lead pads.

A rear electrode then is deposited on the dielectric layer, leaving a window over the front lead pad. The rear electrode may comprise conductive particles, such as silver, carbon, graphite, or nickel particles, which are advantageously dispersed in a polymeric binder to form a screen-printable ink.

By way of example, the rear electrode may be about 0.0005 inch thick when composed of silver particles. Preferably, the rear electrode is sufficiently thick to provide the requisite conductivity, and may also be opaque so that light does not emanate from the rear of the lamp.

In one particular embodiment of the present invention, the rear electrode terminates at least about 0.010 inch from the edge of the lamp; more preferably, the rear electrode is at least about 0.020 to about 0.050 inch away from the edge. The distance of the rear electrode from the edge of the lamp will be determined by the application of the lamp. Preferably, the rear electrode is not farther than about 0.050 inch from the edge since this results in a smaller luminescent area within the lamp. The rear electrode also preferably terminates at least about 0.010 inch, and more preferably at least about 0.020 to about 0.050 inch away from the front lead pad.

An optional next layer of a clear resin may be applied over the rear electrode layer by screen printing or other suitable coating method.

Other additional layers may optionally be included in the electroluminescent lamp of the present invention. For example, color filters may be applied. Color filters include, for example, Roscolene-817-Amber, Roscolene-837-Red and Roscolene-861-Blue (Rosco Corp., Port Chester, N.Y.). The lamp can optionally include an optical filter to enhance infrared emission, for example. See, for example, U.S. Pat. No. 4,857,416, which is incorporated by reference herein in its entirety. Additionally, if desired, the lamp can optionally include an optical filter to enhance or modify ultraviolet emission.

Dyes may also be included within the phosphor material itself, using paint mixing or dye dispersion techniques. An illustrative example of a dye which may be utilized in the practice of the invention is Nile Red 52445 red fluorescent dye (CAS Registry No. 7385-67-3, Eastman Kodak Co., Rochester, N.Y.).

The lamp can also optionally have, for example, protective or decorative coatings over its surface. Additionally, the lamp can have a colored transparent coating on its surface to impart a selected color to the light emitted by the lamp.

A moisture barrier layer is preferably applied over the rear electrode, for example, to help prevent electrical shorting or to provide a moisture barrier thereby protecting the phosphor particles. The moisture barrier layer is preferably screen printed over the rear electrode.

An additional electrical insulating layer can also be applied, for example the insulating layer may be preformed and laminated to the lamp using, for example, a pressure sensitive adhesive. Alternatively, a screen printed electrical isolation layer could be used. If a preformed film is used, the insulation in the area of the window may optionally be cut away to allow an electrical connection to the electrode layers. The window area may be cut away before or after the application of the insulation.

Next, lead terminals are optionally attached to the front lead pad and the rear electrode to supply a means for providing power to the electroluminescent lamp. A first lead terminal is attached to the rear electrode and the front electrode, in the area coinciding with the mechanically rotationally abraded area of the front electrode. A second lead terminal is attached to the front electrode, in an area other than the mechanically rotationally abraded area. The second lead terminal is not attached to the rear electrode. The mechanically rotationally abraded area thus permits attachment of the first lead terminal to both the front substrate where the conductive material has been abradingly removed, and to the rear electrode, without causing short circuiting.

A lead terminal that causes deformation in the layers of the lamp may be used, which for example, pierces, crimps, or compresses a layer or layers of the lamp. The mechanically rotationally abraded area of an electrode layer in the electroluminescent lamps of the present invention provides an electrically discontinuous area that permits attachment of a lead terminal that may optionally be deforming in character.

For example, eyelets that are inserted in holes cut in the lamp and crimped in place may be used for lead terminals. Other lead terminals include, for example, an alligator clip, a flexible film contact, spring-loaded connectors, and conductive rubber. Thus, the lead terminals can be fully or semi-invasive.

It will be understood by those skilled in the art that an electroluminescent lamp can alternatively be made from the rear electrode forward. Furthermore, in certain embodiments, the rear electrode can be abraded instead of or in addition to the front electrode.

The lamp may be formed as multiple units, for example, in a panel, and each individual lamp may then be cut from the panel.

The completed electroluminescent lamp may be used for a number of different lighting purposes.

Figure 15:
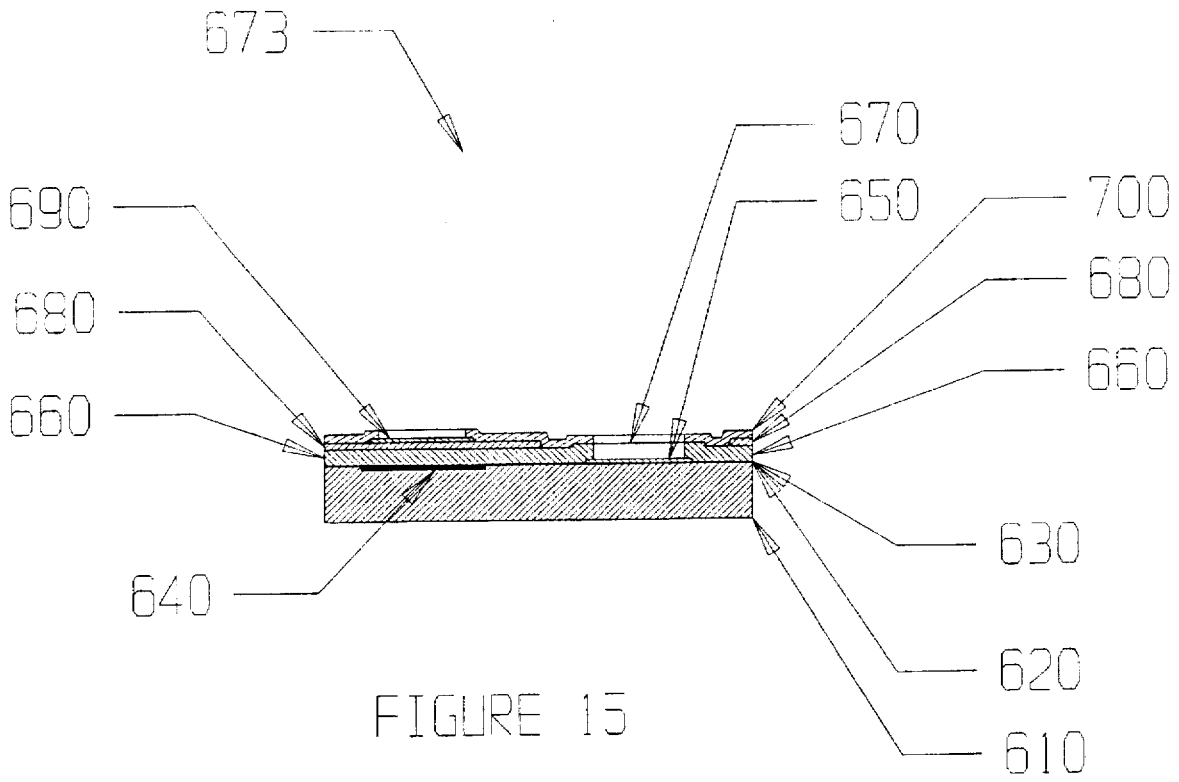
FIG. 15 is a cross-sectional elevation view schematic representation of an electroluminescent lamp of the present invention.

A cross-sectional elevation view of an example of an electroluminescent lamp 673 according to one embodiment of the present invention is shown schematically in FIG. 15. As shown in FIG. 15, the substrate layer 610 of the front electrode 620 has a layer of conductive material 630 from which a region 640 has been formed by rotary abrasion, thereby eliminating the conductive material in the area subjected to the mechanical rotational abrasion. The front electrode 620 is connected to a front lead pad and optional bus bar 650 for connection to a lead terminal. The front electrode 620 and the optional bus bar 650 are layered over by a phosphor layer 660, which has a window 670 over the front lead pad. The dielectric layer 680 is placed adjacent to the phosphor layer 660, and also has a window (not shown)

over the front lead pad. The rear electrode 690 is layered over the dielectric layer 670, and has a window (not shown) over the front lead pad. The exposed layers are then layered over by the moisture barrier 700 and also has a window over the front lead pad and rear lead pad.

Figure 16:
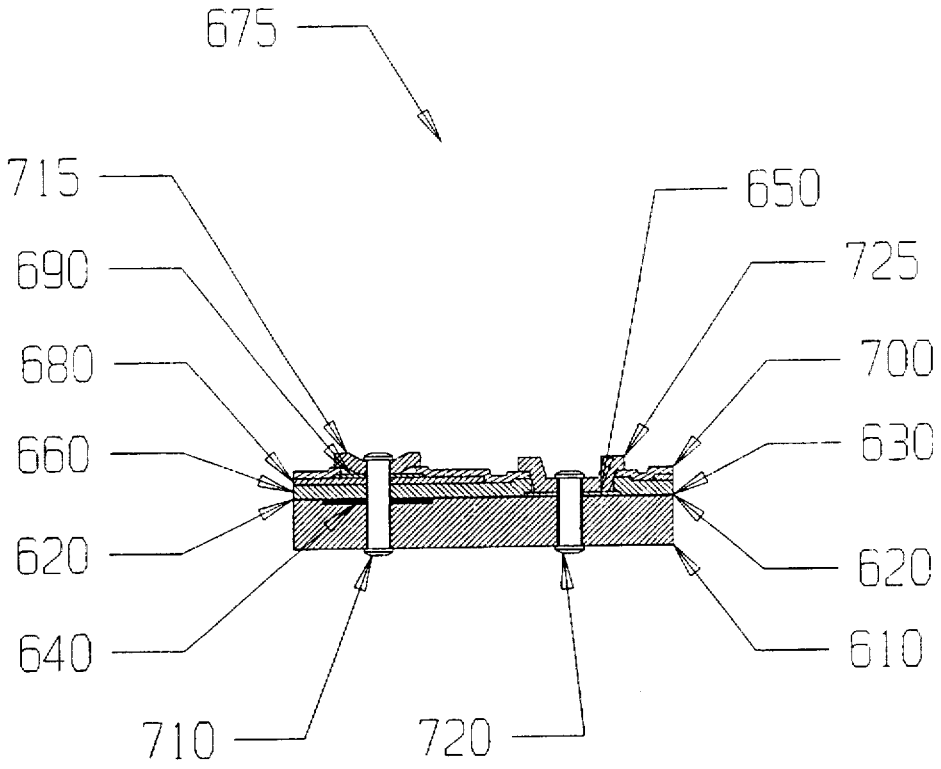
FIG. 16 is a cross-sectional elevation view schematic representation of the electroluminescent lamp of FIG. 15 showing the attachment of a deforming connector in the lead attachment region.

A cross-sectional view of an example of a deforming attachment to an electroluminescent lamp 675 of the present invention is shown schematically in FIG. 16. As illustrated in FIG. 16, the deforming connection 700 is attached to an optional external lead 715, and the rear electrode 690 and the front electrode 620 (comprising substrate 610 and conductive material film 630 coated thereon) in an area coincident with the mechanically rotationally abraded area 640. A second deforming connection 720 is attached to an optional external lead 725, and the front electrode 620.

The features, aspects, and advantages of the present invention are further shown with respect to the following non-limiting examples.

EXAMPLE 1

Removal of Metal Oxide Film from an Electrode Using a Felt-Tipped Tool

An abrasive tipped, spring loaded tool, 0.25 inches in diameter, was attached to a 3 axis computer numerical control (CNC) machine spindle. The abrasive tip of the tool was constructed from a soft density wool blend obtained from Boston Felt. The spindle was operated at 8,000 revolutions per minute and the CNC feed rate of the panel of lamps was 25 inches per minute. The abrasive tool was placed into contact with the metal oxide conductive material on the carrier film substrate sheet and a pattern was traced by the CNC machine. The areas touched by the abrasive tipped tool showed complete removal of the metal oxide film from the carrier film surface. The pattern created was an approximately rectangular area measuring 0.48 inches by 0.40 inches and the pattern was repeated 77 times on the sheet, which was cut to form 77 lamps. The time required for the CNC machine to complete the pattern, after setup, was 7 minutes.

EXAMPLE 2

Removal of Metal Oxide Film from an Electrode Using a Steel Bristle Brush

An abrasive tipped, spring loaded tool, 0.18 inches in diameter, was attached to a 3 axis computer numerical control (CNC) machine spindle. The abrasive tip of the tool was a steel bristle brush obtained from J. S. Ritter. The spindle was operated at 6,000 revolutions per minute and the CNC feed rate of the panel of lamps was 20–30 inches per minute. The abrasive tool was placed into contact with the metal oxide conductive material on the carrier film substrate sheet and a pattern was traced by the CNC machine. The areas touched by the abrasive tipped tool showed complete removal of the metal oxide film from the carrier film surface. The pattern created was an approximately rectangular area measuring 0.48 inches by 0.40 inches and the pattern was repeated 77 times on the sheet, which was cut to form 77 lamps. The time required for the CNC machine to complete the pattern, after setup, was about 5–6 minutes.

EXAMPLE 3

Removal of Metal Oxide Film from an Electrode Using a Brass Bristle Brush

Example 2 was repeated using a brass bristle brush obtained from J. S. Ritter, and the same results were obtained.

EXAMPLE 4

Removal of Metal Oxide Film from an Electrode Using a Stiff Bristle Brush

Example 2 was repeated using a stiff bristle brush obtained from J. S. Ritter, and the same results were obtained.

EXAMPLE 5

Removal of Metal Oxide Film from an Electrode Using a Brass Bristle Brush

An abrasive tipped, spring loaded tool, 0.18 inches in diameter, was attached to a 3 axis computer numerical control (CNC) machine spindle. The abrasive tip of the tool was a brass bristle brush obtained from J. S. Ritter. The spindle was operated at 6,000 revolutions per minute and the CNC feed rate of the panel of lamps was 20–30 inches per minute. The abrasive tool was placed into contact with the metal oxide conductive material on the carrier film substrate sheet and a pattern was traced by the CNC machine. The areas touched by the abrasive tipped tool showed complete removal of the metal oxide film from the carrier film surface. The pattern created was an approximately oval in shape forming an area measuring about 0.13 inches by about 0.375 inches and the pattern was repeated 20 times on the sheet, which was cut to form 20 lamps. The time required for the CNC machine to complete the pattern, after setup, was 1.5 minutes.

EXAMPLE 6

Removal of Metal Oxide Film from an Electrode Using a Felt Tipped Brush

Example 5 was repeated using a steel bristle brush obtained from J. S. Ritter, and the same results were obtained.

Although the invention has been described with respect to particular features, aspects and embodiments thereof, it will be apparent that numerous variations, modifications, and other embodiments are possible within the broad scope of the present invention, and accordingly, all variations, modifications and embodiments are to be regarded as being within the spirit and scope of the invention.

We claim:

1. An electroluminescent lamp comprising an electrode layer including a substrate with a main surface which has been coated with a film of a conductive material and at least one additional material layer, the substrate comprising a region at least inch 0.10 wide where the conductive material film has been removed from the substrate by rotary abrasion prior to coating of said additional material layer.

2. An electroluminescent lamp comprising an electrode layer including a substrate with a main surface which has been coated with a film of a conductive material, the substrate comprising a region at least 0.10 inch wide where the conductive material film has been removed from the substrate by rotary abrasion, wherein said region comprises a lead attachment region or an edge isolation region.

3. An electroluminescent lamp comprising an electrode layer including a substrate with a main surface which has been coated with a film of a conductive material, the substrate comprising a region at least 0.10 inch wide where the conductive material film has been removed from the substrate by rotary abrasion, wherein said region comprises a lead attachment region.

4. An electroluminescent lamp according to claim 3, further including a second electrode layer, and a pair of lead terminals wherein one of the lead terminals engages with the second electrode layer and said region on the first electrode layer.

5. An electroluminescent lamp according to claim 4, wherein the other lead terminal engages with the first electrode layer and not with the second electrode layer.

6. An electroluminescent lamp according to claim 1, wherein the substrate exposed from the removal of the conductive material has visually discernible striations from said rotary abrasion.

7. An electroluminescent lamp comprising an electrode layer including a substrate with a main surface which has been coated with a film of a conductive material, the substrate comprising a region at least 0.10 inches wide where the conductive material film has been removed from the substrate by rotary abrasion, wherein the substrate exposed from the removal of the conductive material has visually discernible striations from said rotary abrasion, wherein the striations are circular markings.

8. An electroluminescent lamp comprising an electrode layer including a substrate with a main surface which has been coated with a film of a conductive material, the substrate comprising a region at least 0.10 inch wide where the conductive material film has been removed from the substrate by rotary abrasion.

9. An electroluminescent lamp according to claim 8, wherein the region is at least 0.15 inch wide.

10. An electroluminescent lamp according to claim 8, wherein the region is at least 0.20 inch wide.

11. An electroluminescent lamp according to claim 8, wherein the region comprises a lead attachment region.

12. An electroluminescent lamp according to claim 11, wherein the lead attachment region is at least 0.15 inch wide.

13. An electroluminescent lamp according to claim 11, wherein the lead attachment region is at least 0.20 inch wide.

14. An electroluminescent lamp according to claim 8, wherein the region comprises a portion of a marginal edge of the lamp.

15. An electroluminescent lamp according to claim 14, wherein the region is at least 0.15 inch wide.

16. An electroluminescent lamp according to claim 14, wherein the region is at least 0.20 inch wide.

17. An electroluminescent lamp according to claim 8, wherein the region comprises a lead attachment and a portion of a marginal edge of the lamp.

18. An electroluminescent lamp according to claim 17, wherein the region is at least 0.15 inch wide.

19. An electroluminescent lamp according to claim 17, wherein the region is at least 0.20 inch wide.

20. An electroluminescent lamp comprising an electrode layer including conductive material coated on a substrate, the substrate having a region absent conductive material, the region being at least about 0.10 inches wide and the region having been formed by rotary mechanical abrasion of the conductive material thereon.

21. An electroluminescent lamp comprising an electrode layer including a conductive material coated on a substrate and the substrate being coated with at least one additional material layer, the substrate having a channel at least 0.10 inch wide on an edge of the lamp, the channel being absent conductive material, and having been formed by rotary mechanical abrasion of the conductive material thereon prior to coating of said additional material layer.

22. An electroluminescent lamp according to claim 21, wherein the lamp has marginal edges, and the electrode layer of the lamp has a channel absent conductive material on at least a portion of said marginal edges.

23. A method for manufacturing an electroluminescent lamp wherein the lamp comprises an electrode layer including a conductive material and at least one additional material layer on a substrate, the method comprising removing a portion of the conductive material at least 0.10 inch wide using rotary abrasion prior to forming said additional material layer.

24. A method for manufacturing an electroluminescent lamp wherein the lamp comprises an electrode layer including a conductive material on a substrate, the method comprising rotationally mechanically abrading a portion of the conductive material to yield a region of the substrate absent conductive material and at least about 0.10 inches wide.

25. A method according to claim 24, wherein said region defines a lead terminal connection.

26. A method according to claim 24, wherein said region is at least about 0.15 inches wide.

27. A method according to claim 24, wherein said region is at least about 0.20 inches wide.

28. A method according to claim 24, wherein the step of rotationally mechanically abrading is performed using a tool having a shaft that moves in a rotary motion, the shaft being attached to a brush, and the brush having bristles that are parallel to the shaft of the tool.

29. A method according to claim 24, wherein the rotary motion in x, y, and z axes is controlled.

30. A method according to claim 24, wherein the step of rotationally mechanically abrading is performed using a tool having a felt tip.

31. A method according to claim 30, wherein the felt tip is round.

32. A method according to claim 30, wherein the felt tip has a flat surface which is contacted with the conductive material in the step of rotationally mechanically abrading.

33. A method for manufacturing an electroluminescent lamp wherein the lamp comprises an electrode layer including a conductive material on a substrate, the method comprising rotationally mechanically abrading a region of the conductive material to yield a region of the substrate absent conductive material forming a channel at an edge of the lamp at least about 0.05 inch wide.

34. A method according to claim 24, wherein the step of rotationally mechanically abrading is performed using a tool having an abrasive tip.

35. A method according to claim 34, wherein the abrasive tip is round.

36. A method according to claim 34, wherein the abrasive tip has a flat surface which is contacted with the conductive material in the step of rotationally mechanically abrading.

* * * * *